US006027280A

United States Patent [19]

Conners et al.

[11] Patent Number: 6,027,280

[45] Date of Patent: Feb. 22, 2000

[54] INTERLOCKING PAVING BLOCK WITH INTERIOR ILLUMINATION CAPABILITY

[75] Inventors: Thomas P. Conners, Reno; Eric Petrilla, Incline Village, both of Nev.

[73] Assignee: Concrete Paving Innovations, LLC, Sparks, Nev.

[21] Appl. No.: 08/837,534

[22] Filed: Apr. 21, 1997

[51] Int. Cl.[7] ..... E01F 9/04

[52] U.S. Cl. ..... 404/19; 404/23; 404/34; 362/153.1; 362/374; 362/548

[58] Field of Search ..... 404/22, 23, 34, 404/19, 21; 362/153, 153.1, 226, 364, 374, 375, 519, 548

[56] References Cited

U.S. PATENT DOCUMENTS

| | | | |
|---|---|---|---|
| 3,249,751 | 5/1966 | Stephens et al. | 362/375 |
| 4,186,432 | 1/1980 | Hamacher | 362/374 X |
| 4,396,972 | 8/1983 | Kaneko et al. | 362/145 |
| 4,697,950 | 10/1987 | Copeland | 404/9 |
| 4,912,610 | 3/1990 | Dahlberg | 362/153.1 |
| 4,992,914 | 2/1991 | Heiss et al. | 362/153.1 |
| 5,156,454 | 10/1992 | White | 362/153 |
| 5,678,920 | 10/1997 | Kerr | 362/145 |
| 5,681,105 | 10/1997 | Nau | 362/153 |
| 5,722,758 | 3/1998 | Huang | 362/548 |
| 5,791,774 | 8/1998 | Briles | 362/153.1 X |

FOREIGN PATENT DOCUMENTS 2173170 7/1997 Canada ..... F21V 33/00

OTHER PUBLICATIONS

Paver Light brochure, Date Unknown.
FiberScape™ Landscape Lights, Specification and Submittal Sheet, 1996.
Night Lighting brochure, 1997.

*Primary Examiner*—James A. Lisehora
*Attorney, Agent, or Firm*—Townsend and Townsend and Crew LLP; Kenneth R. Allen; Scott W. Hewett

[57] ABSTRACT

The present invention provides an interlocking paving block capable of accepting an internal lamp and a pavement of interlocking illuminated paving blocks. In one embodiment, the interlocking paving block has a main body bent from 14 gauge aluminum sheet metal to form upper and lower flanges for attaching and supporting a bottom plate and a lens. The lens is made from a tough, polymeric material, such as polycarbonate sheeting. An access hole in the bottom plate allows a lamp socket and lamp to be inserted into or removed from the interior of the paver block without removing the lens. A top cap secures the lens against the main body, providing a clamping force between the lens and main body to compress a rubber gasket, thus providing an environmental seal. An interior perimeter of the top cap also provides a friction step, thereby improving traction across the top of the paver block.

11 Claims, 6 Drawing Sheets

INTERLOCKING PAVING BLOCK WITH INTERIOR ILLUMINATION CAPABILITY

BACKGROUND OF THE INVENTION

The present invention relates to interlocking pavers as may be used to form a pavement, and more specifically to an illuminated interlocking paver.

Pavements made of interlocking pavers have been used for streets, driveways, walkways, and runways. Interlocking pavers are typically made of from a concrete of Portland cement and aggregates, and may support loads greater than 5,000 psi. Interlocking pavers provide a gap-free surface with no long runs of seams between pavers. Furthermore, many pavers have a thickness comparable to the longest inter-paver seam. For example, an octagonal paver with eight 2.5 inch facet edges may be 2 inches thick. The vertical faces of adjacent pavers support each other in the pavement, unlike tiles. The pavers are typically laid on a screed sand base overlaying a compacted aggregate base, providing a load-equalizing surface and water drainage. The support provided between adjacent pavers by the thickness of the pavers allows each paver to move slightly in a vertical direction without significantly tilting the paver when loaded, such as when a vehicle drives across the pavement. This may allow the load to be shared between pavers, as contrasted with a poured concrete pavement, which may crack rather than move.

Interlocking pavers come in a variety of shapes, such as the keyhole shape 100 shown in FIG. 1A. A V-groove 101 allows the square tab 102 to be broken off of the octagon body 103 for edging and other purposes. The keyhole paver 100 of FIG. 1 has a nominal height 150 of 2.36 inches, but may be as thick as nominally 3.15 inches, and a facet edge length 151 of nominally 2.5 inches. Interlocking pavers also come in the shape of hexagons, truncated squares 110, FIG. 1B, to be used with interstitial squares 111, as well as other shapes.

Interlocking paving stones may provide a superior alternative to poured concrete in many situations. For example, desert climates may not provide proper curing conditions for concrete pavements that are poured in place. Pavements or runways in these areas may have improperly-cured surfaces and interior voids that cause the concrete to crack and wear rapidly. Pavers, on the other hand, may be cast in a controlled environment, resulting in up to three times the strength of poured concrete, and installed at the point of use. Similar advantages are enjoyed in cold climates, where pavers may provide greater resistance to freeze-thaw cracking and better water drainage, thus reducing pavement icing.

Another advantage of interlocking pavers over poured concrete is that the pavers may be formed into a pattern for aesthetic or functional purposes. Pavers of different colors or shapes may be used to delineate different regions of a pavement, for example different colored pavers could identify the center line of a driveway. However, it may be difficult to distinguish between the different types of pavers at night. An illuminated paver may be desirable for identifying portions of a pavement at night, such as the center line of a road or the border of a driveway. Illuminated pavers may also improve safety on stair treads and walkways, especially if the heat from the illuminated paver is sufficient to melt accumulated snow.

Some attempts have been made at providing an illuminated paver system. One system forms concrete pavers with vertical through-holes that accept a point-source fiber-optic light fixture. The light fixtures utilize a glass lens that is rated at a maximum load of 992 psi. Each light fixture should be within 50 feet of a central light source. Larger pavements would require multiple light sources, which are expensive.

The glass lens is relatively fragile and susceptible to breakage, as when driven over with snow chains or studded tires. Additionally, the small point of light may be difficult to see and provides little lighting power.

Another attempt at providing an illuminated paver system addresses the issue of border pavers. This system provides brick-shaped lamps designed to be installed in the borders of interlocking paver installations. This lamp has a smooth lens surface that may offer very low friction in wet or dusty conditions. The lens also overhangs the cast plastic body of the lamp, precluding the vertical faces of adjacent lamps from providing inter-lamp support, as discussed above. Furthermore, the strength of the lamp may be inadequate to form an illuminated pavement, restricting its use to where it is surrounded by conventional concrete pavers that can support the traffic load.

Therefore, it is desirable to be able to form a pavement of illuminated interlocking pavers. It is further desirable that the interlocking pavers have sufficient strength to support the dynamic or static loads associated with vehicular traffic and provide reasonable traction across the illuminated paver surface. It is further desirable that the illuminated pavers be sufficiently durable to withstand being driven over with tire chains or studded tires, and that the pavers may be illuminated by light sources of differing powers or colors.

SUMMARY OF THE INVENTION

The present invention provides an interlocking paving block capable of accepting an internal lamp. In one embodiment, the interlocking paving block has a main body bent from 14 gauge aluminum sheet metal to form upper and lower flanges for attaching and supporting a bottom plate and a lens. The bottom plate may be made of the same material as the main body and may be spot welded or otherwise attached to the main body. The lens is made from a tough, polymeric material, and in a specific embodiment is made from polycarbonate sheeting. An access hole in the bottom plate allows a lamp socket and lamp to be inserted into or removed from the interior of the paver block. A lamp clip inside the paver block has an appropriately-formed cutout accepts to securely hold the lamp socket, which may have a bayonet-style twist mount, for example. The lamp clip may be spot welded to the bottom plate, or otherwise attached inside the paver block. In one embodiment, a top cap secures the lens against the main body, providing a clamping force so that the lens may compress a rubber gasket between the upper flange on the main body and the lens, providing an environmental seal. An interior perimeter of the top cap also provides a friction step, thereby improving traction across the top of the paver block.

In another embodiment of the present invention, a plurality of interlocking paving blocks, each capable of illumination by an internal lamp and each having an upper lens surface substantially equal to the cross-section of the paver block, are placed adjacent to one another to form at least part of a pavement. This pavement may appear uniform during the day, while creating a multi-colored pattern when illuminated at night.

These and other embodiments of the present invention, as well as its advantages and features are described in more detail in conjunction with the text below and attached figures.

DESCRIPTION OF THE PREFERRED EMBODIMENT

An illuminated paver according to one aspect of the present invention provides a true interlocking paver with a lens forming an upper surface of the paver. The lens is strong and stiff and resists breaking and bending when driven over with a vehicle, as well as being translucent or transparent. A bezel around the perimeter of the lens provides a friction step for improved traction. The body of the illuminated paver has sides that may support adjacent illuminated pavers or concrete pavers. As used in this specification and claims, "illuminated paver" refers to a paver capable of internal illumination, and does not necessarily means a paver that includes a lamp other means of illumination, nor does it necessarily mean a paver that is presently illuminated.

Figure 1A:
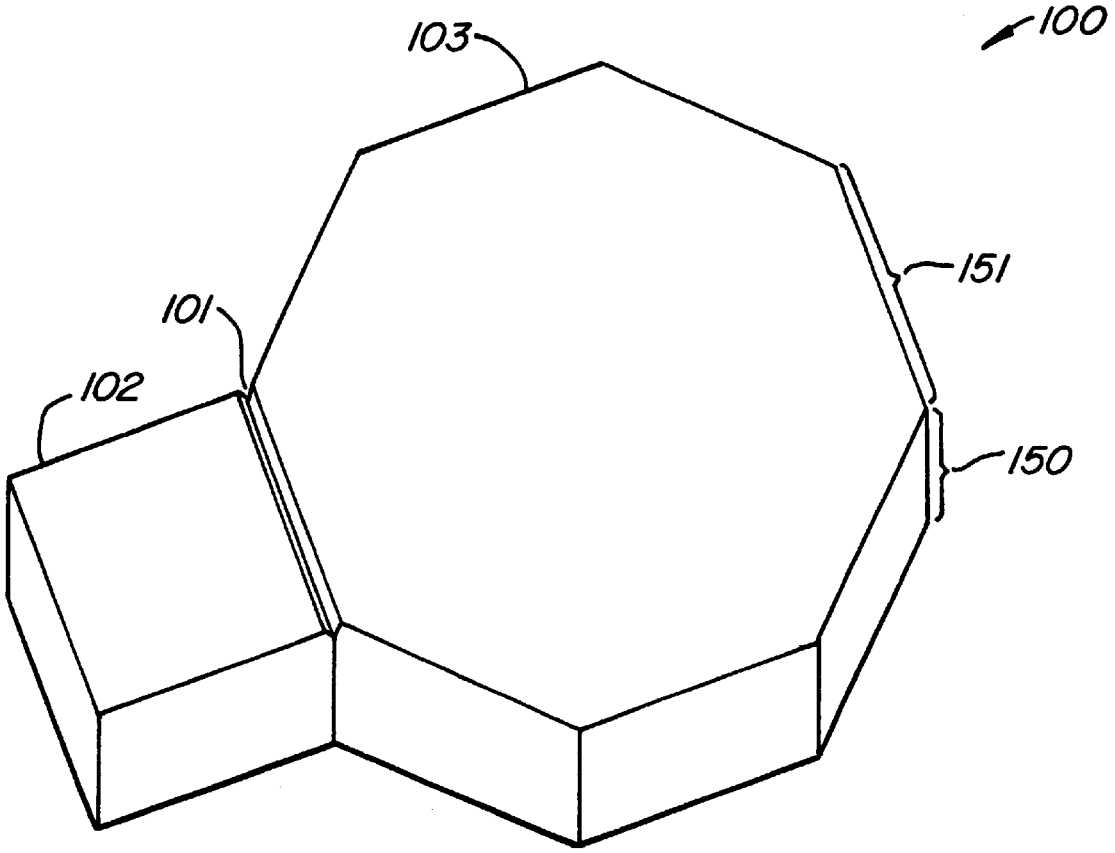
FIG. 1A. PRIOR ART
FIG. 1A is an isometric view of one type of interlocking paver block.
Figure 1B:
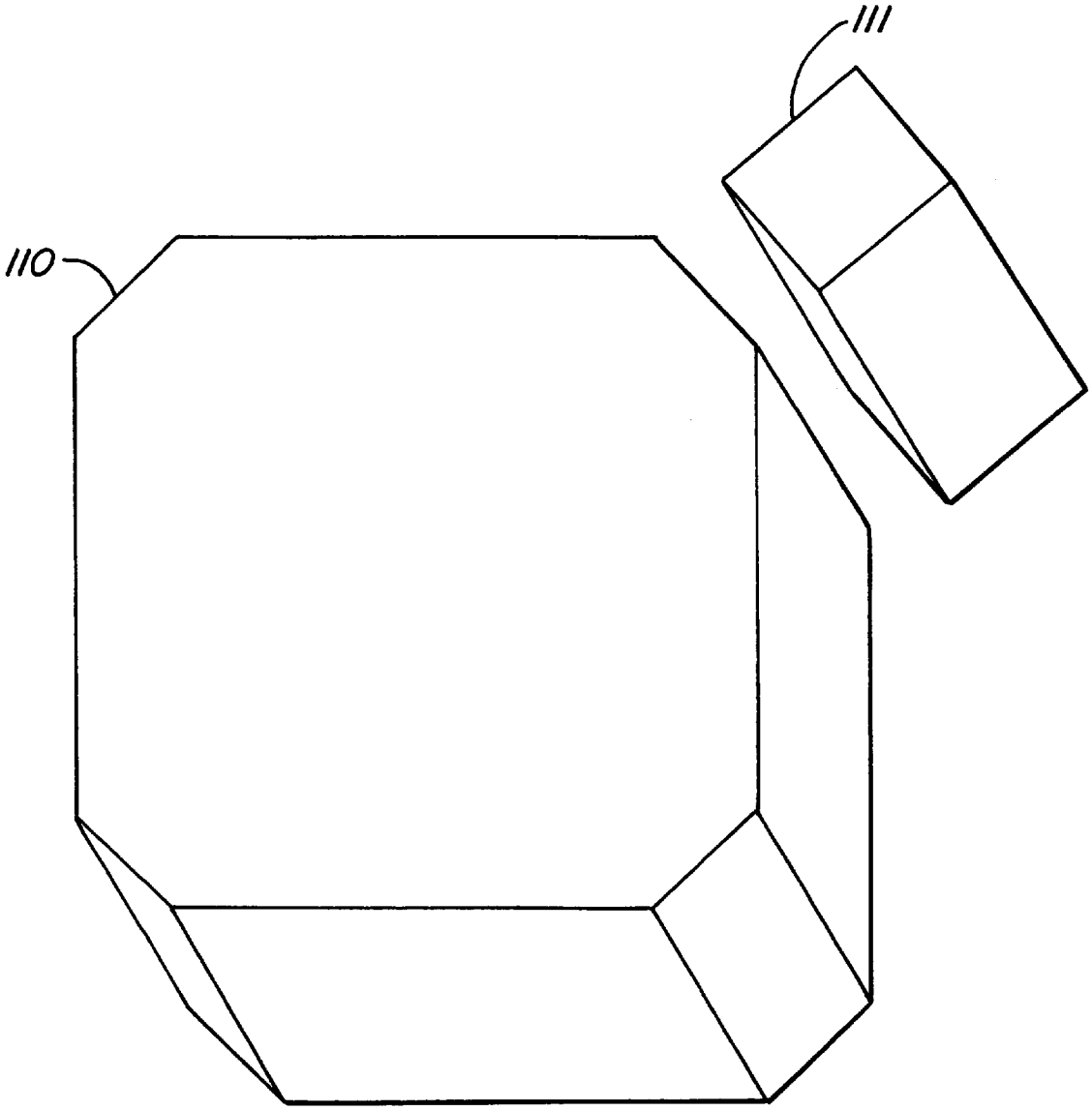
FIG. 1B. PRIOR ART
FIG. 1B is an isometric view of another type of interlocking paver block.
Figure 2A:
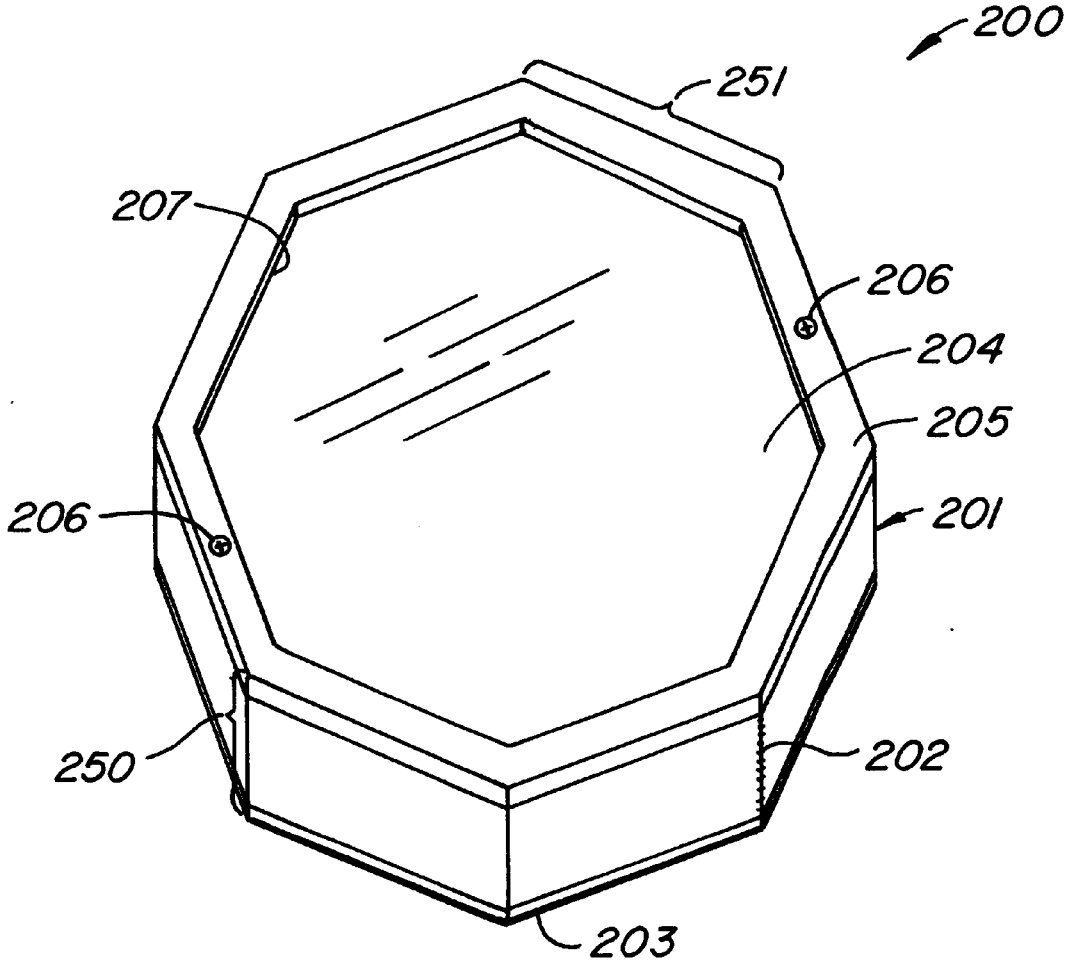
FIG. 2A is a simplified isometric view of an illuminated paver according to one aspect of the present invention.

FIG. 2A shows a simplified isometric view of an illuminated paver 200 according to one embodiment of the present invention. A main body 201 is fabricated from sheet metal, such as 14 gauge aluminum, or stainless steel sheet metal of similar strength, in substantially the shape of the octagon body 103 of FIG. 1. The illuminated paver has a height 250 of nominally 2.36 inches, and a facet edge length 251 of nominally 2.5 inches. A sheet metal development is bent to the shape of the main body and may be welded together at an edge seam 202. Fabricating the main body from sheet metal allows different shapes to be bent from different developments, if desired, with minimal tooling costs. The main body could also be fabricated by other means, such as casting. The main body may be placed outdoors on a prepared bed of sand or aggregate, therefore it is desirable, but not essential, that the main body not rust.

A bottom plate 203 is attached to the main body 201, such as by spot welding the bottom plate to lower flanges (not shown in this view) on the main body. In a specific embodiment, the bottom plate is made of the same material stock as the main body. A plastic lens 204 is held in place by a top cap 205, which is removably-attached to the main body with screws 206, such as flat-topped Phillips head machine screws. The plastic lens 204 is preferably made of a strong, tough, light transmissive polymer, such as 0.25 inch thick polycarbonate sheet. The top cap 205 is formed from plain steel, and may be coated with epoxy powder coating, or other suitable coating, to match or contrast the color of other pavers that may be used in a pavement. The top cap 205 may be fabricated from materials other than plain steel, such as stainless steel; however, fabricating the top cap 205 from plain steel allows this trim piece of the illuminated paver 200 to weather slightly. This may provide a more natural-looking effect over time.

The top cap 205 also provides a friction step 207 along the inside perimeter of the top cap 205 on the lens surface. When driven over, a vehicle tire or shoe sole may deform around this friction step, thereby gaining greater traction than may have been available with a smooth lens surface. The top cap 205 also provides a relatively large clamping area to hold the lens against the body. This large clamping area avoids lens cracking at the screw holes that may result if the lens is directly attached to the main body with screws. The screws 206 that attach the top cap 205 to the main body 201 are flat-head screws that are flush with the upper surface of the top cap. The heads of the screws may be powder coated to match the color of the top cap.

This embodiment of top cap 205, plastic lens 204, and main body 201 provides a shape with straight, flush sides that are perpendicular to the upper surface of the lens. This allows the resultant illuminated paver to support, and to be supported by, adjacent pavers.

Figure 2B:
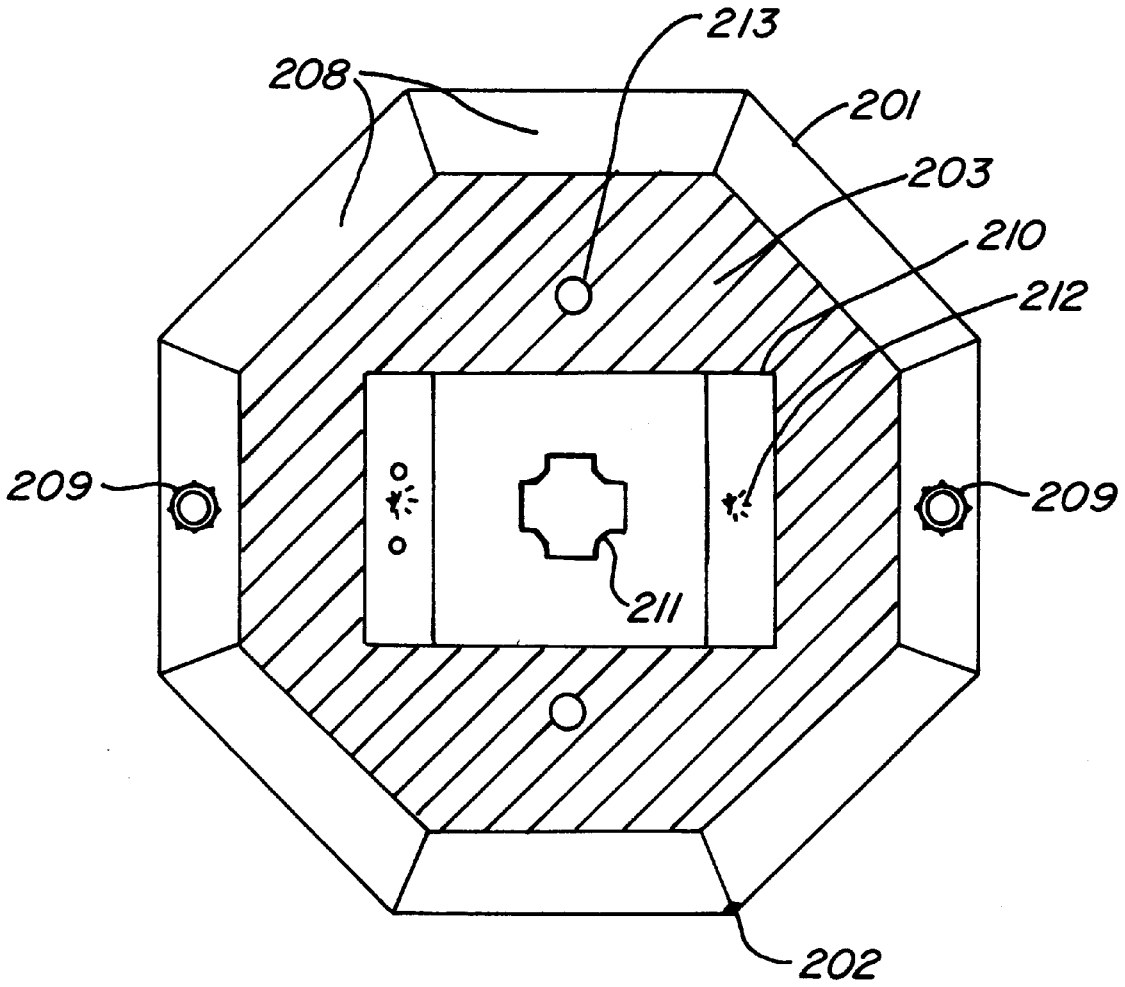
FIG. 2B is a simplified plan view of portions of an illuminated paver according to one aspect of the present invention.

FIG. 2B is a simplified plan view, looking down, of the illuminated paver with the top cap 205 and plastic lens 204 removed. The main body 201 is folded from the sheet metal development to provide upper flange 208, upon which the lens may sit. The bottom plate 203 is spot welded to similar lower flanges (not shown in this view). Threaded inserts 209 may be inserted into the upper flanges 208 to accept the screws that attach the top cap to the main body. Alternatively, the flange may be drilled and tapped to accept the screws, or the lens may be attached to the main body with adhesive sealant.

A lamp clip 210 has a socket cut-out 211 to receive a lamp socket (not shown). The lamp clip 210 is fabricated from sheet metal, typically thinner than the sheet metal used for the main body, and is attached to the bottom plate with spot welds 212. The lamp clip 210 holds the lamp socket and lamp (also not shown) off the bottom plate, where water may accumulate during use. The bottom plate 203 has drainage holes 213 to allow drainage of water from the illuminated paver.

A lamp socket may be installed through an access hole (not shown in this view) beneath the socket cut-out 211 in the bottom plate 203. The lamp clip 210 provides a space beneath the socket cut-out 211 for storing wiring associated with the lamp socket. This allows the use of "pig-tail" lamp fixtures. Pig-tail lamp fixtures provide additional wire sufficient to lift the paver from the pavement and gain access to the access hole in the bottom plate. This allows changing bulbs or bulb types without disturbing the wiring underlying the pavement, and without removing the lens or disturbing the lens-to-main body seal provided by the gasket. The additional wire is coiled (hence the name "pig-tail") into the space beneath the lamp clip 210 as the paver is placed back into the pavement.

Figure 3:
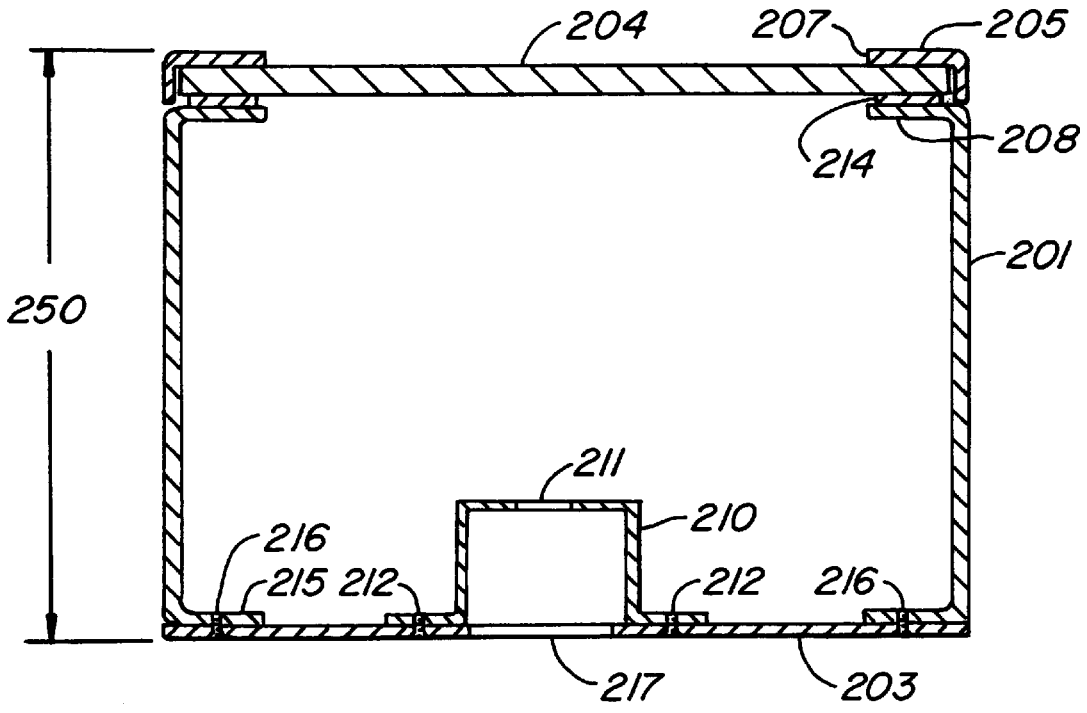
FIG. 3 is simplified cross-sectional view of an illuminated paver.

FIG. 3 is a cross-sectional side view of an illuminated paver according to one embodiment of the present invention. A gasket 214 is placed between the plastic lens 204 and the upper flange 208 of the main body 201. The gasket is made of 1/16 inch thick red rubber sheet, but may be made of other materials, such as neoprene rubber foam sheet. Additionally, because the access hole 217 in the bottom plate 203 allows inserting a lamp socket (not shown) into the socket cut-out 211 without removing the plastic lens 204, the gasket may be made out of an adhesive sealant material, such as silicon or acrylic adhesive sealant. As seen in this view, the bottom plate 203 is at spot weld 216 to the lower flange 215. The height 250 of the paver is chosen to match the height of adjacent pavers in the pavement, such as the height of the concrete paver shown in FIG. 1A. The side of the main body 201 forms a vertical face that can provide support to adjacent pavers in a pavement. Neither the lens or the top cap overhangs the side of the main body, is doing so may interfere with inter-paver support by adjacent vertical faces.

Figure 4:
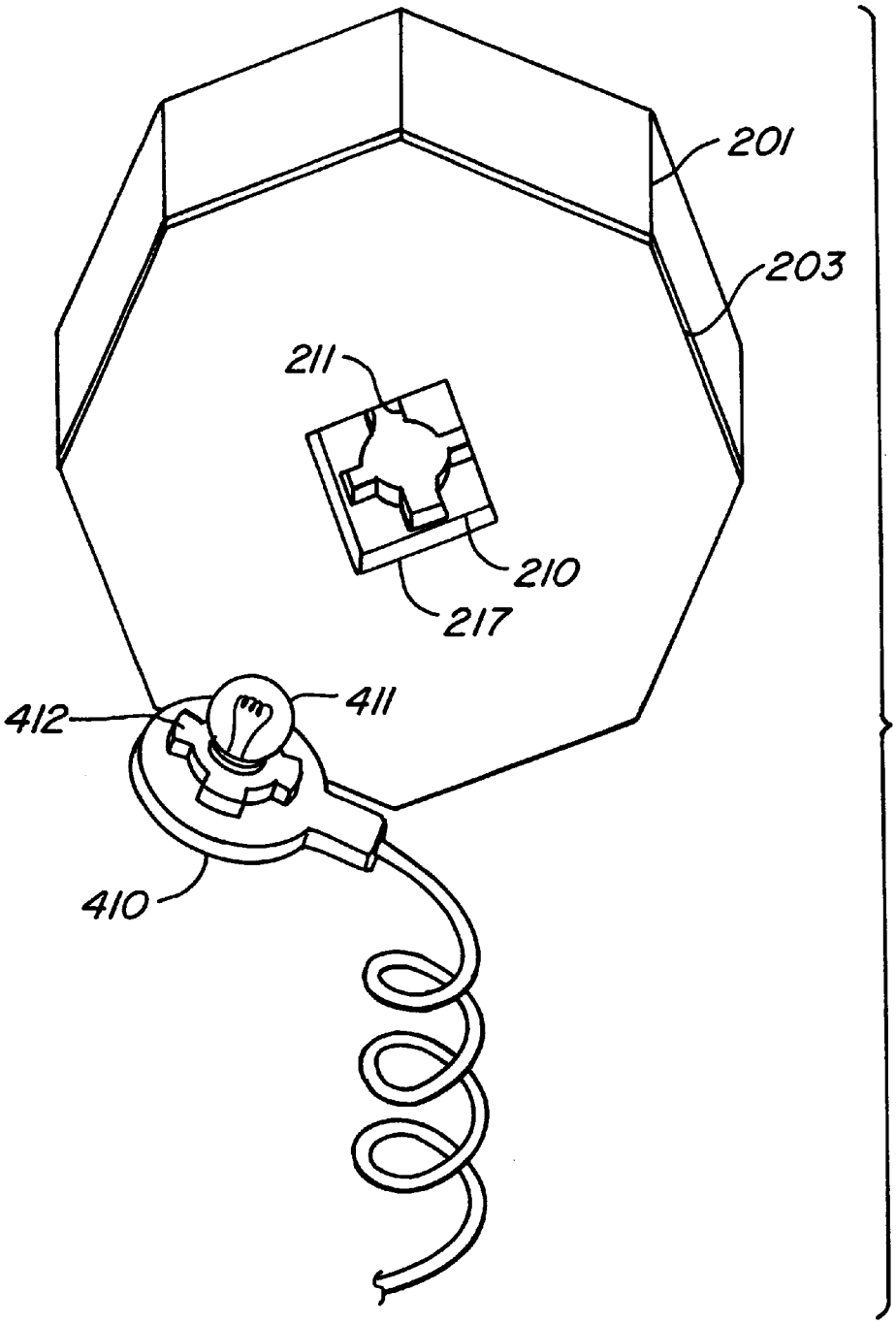
FIG. 4 is a simplified view of a paver and a lamp socket prior to installing the lamp socket into the paver through an access hole.

FIG. 4, which is not drawn to scale, is a simplified exploded view of one embodiment of an illuminated paver showing how a lamp socket 410, containing a lamp 411, may be inserted into the paver through the access hole 217 in the bottom plate 203. The lamp socket 410 has a bayonet-type mounting ring 412 that is inserted through the socket cut-out 211 in the lamp clip 210, and is twisted to securely mount the lamp socket in the socket cut-out. In some instances, a tool may be used to assist in holding and twisting the lamp socket. In other instances, the lamp socket is formed in an "L" or "T" shape, providing a lever arm to assist in twisting the lamp socket into place and allowing a workman to assemble the lamps in the pavers without the use of special tools. In one embodiment, an automotive-style side marker light socket specified as a replacement for General Motors Corporation part numbers 12001470, 12116169, and 12078187, the same part also being specified as a replacement for DELCO® part number LS-19, was used. Such light sockets are typically available from automotive electric and low-voltage parts suppliers.

In another embodiment of the invention, illuminated pavers are assembled adjacent to each other to form an illuminated pavement. The lens material may be colored different colors, to match or contrast other pavers in the pavement. Furthermore, different colored lamps or lamps of different intensity may be used inside the different pavers. This provides a pavement that shows one pattern (the paver and lens colors) during daylight, and another pattern (the color of the lamps and lenses) when illuminated. This effect may be used to create a pavement, such as a driveway or runway, appearing as a pavement with one pattern during the day and an illuminated pattern, such as a commercial logo, at night.

In yet another embodiment of the invention, the lens is made of textured polycarbonate sheet to further improve traction on the lens surface. In this and other embodiments, the top cap may be omitted from the paver.

While the above is a complete description of specific embodiments of the present invention, various modifications, variations, and alternatives may be employed. For example, the bottom plate may be attached to the lower flange and lamp clip with rivets, rather than spot welds. Additionally, the main body may be cast from metal, rather than bent from sheet metal. Other variations will be apparent to persons of skill in the art. These equivalents and alternatives are intended to be included within the scope of the present invention. Therefore, the scope of this invention should not be limited to the embodiments described, and should instead be defined by the following claims.

What is claimed is:

1. An interlocking paving block capable of accepting an internal lamp, the interlocking paving block comprising:

a main body having an upper flange, a lower flange, and an interior, the interior including a lamp clip;

a bottom plate with an access hole providing access to install a lamp socket in a socket cutout in the lamp clip, said lamp clip being attached to said bottom plate and said bottom plate being attached to said lower flange;

a light-transmissive polymeric lens supported by said upper flange; and a top cap removably-affixed to said main body, said top cap at least partially overlying said lens, thereby forming a friction step between an inside perimeter of said top cap and a face of the light-transmissive polymeric lens.

2. The interlocking paving block of claim 1 wherein said light-transmissive polymeric lens comprises polycarbonate.

3. The interlocking paving block of claim 1 wherein said main body is formed from sheet metal.

4. The interlocking paving block of claim 3 wherein said sheet metal is about 14 gauge aluminum sheet metal.

5. The interlocking paving block of claim 1 further comprising a gasket disposed between said lens and said upper flange.

6. The interlocking paving block of claim 5 wherein the gasket comprises adhesive sealant.

7. The interlocking paving block of claim 1 further comprising a lamp socket removably-affixed to said lamp clip at said socket cut-out; said lamp socket being capable of installation or removal through said access hole in said bottom plate.

8. The interlocking paving block of claim 7, wherein said lamp socket comprises a bayonet-type mounting structure such that said lamp socket may be attached to or removed from said lamp clip at said socket cut-out by twisting said lamp socket relative to said lamp clip.

9. An interlocking paving block capable of accepting an internal lamp comprising:

a main body having an upper flange, a lower flange, and an interior, wherein said main body is fabricated from about 14 gauge aluminum sheet metal;

a bottom plate with an access hole providing access to a socket cutout in a lamp clip within said interior of said main body, said lamp clip being spot welded to said bottom plate and said bottom plate being spot welded to said lower flange;

a light-transmissive lens comprised of polycarbonate sheet supported by said upper flange;

a top cap removably-affixed to said main body, wherein said top cap at least partially overlies said lens, thereby forming a friction step at an inside perimeter of said top cap; and a rubber gasket disposed between said lens and said upper flange.

10. A traffic-bearing pavement capable of at least partial illumination comprising:

a first interlocking paving block capable of illumination including a body having an interior, a side capable of providing a vertical face to support an adjacent paving block, a bottom with an access hole, and a polycarbonate lens attached to said body and forming a top of the interlocking paving block, said polycarbonate lens being fabricated from polycarbonate sheet, a top cap at least partially overlapping the polycarbonate lens to form a friction step between an inside perimeter of said top cap and a face of the polycarbonate lens, and a lamp socket with a lamp within said interior, said lamp socket and lamp capable of being inserted or removed through said access hole and wherein said lamp socket is removably-attached to a lamp clip; and a second interlocking paving block adjacent to said first interlocking paving block in said pavement, wherein said second interlocking paving block is substantially similar to said first interlocking paving block.

11. An interlocking paving block capable of accepting an internal lamp, the interlocking paving block comprising:

a main body having an upper flange, a lower flange, and an interior defined by substantially planar walls that are substantially perpendicular to the upper flange, wherein said main body is fabricated from aluminum sheet metal;

a bottom plate with a lamp clip, an access hole in the bottom plate providing access to a socket cutout in the lamp clip within the interior of the main body;

a light-transmissive lens comprised of polycarbonate sheet supported by said upper flange; and a top cap overlying a perimeter portion of said lens to form a friction step between a face of the lens and an inside perimeter of said top cap.

* * * * *